US005531639A

United States Patent [19]

Catalfamo

[11] Patent Number: 5,531,639

[45] Date of Patent: Jul. 2, 1996

[54] SMOOTHING MILL WITH SUCTION, BY DEPRESSION IN THREE STAGES, OF DUST SO GENERATED

[76] Inventor: Giuseppe Catalfamo, Via Sanvito Silvestro, 14, Varese, Italy

[21] Appl. No.: 256,480

[22] PCT Filed: Jan. 22, 1993

[86] PCT No.: PCT/IT93/00004

§ 371 Date: Jul. 8, 1994

§ 102(e) Date: Jul. 8, 1994

[87] PCT Pub. No.: WO93/14904

PCT Pub. Date: Aug. 5, 1993

[30] Foreign Application Priority Data

Jan. 24, 1992 [IT] Italy ..... MI92A0124

[51] Int. Cl.[6] ..... B24B 55/06

[52] U.S. Cl. ..... 451/456; 451/520

[58] Field of Search ..... 451/359, 344, 451/956, 295, 520, 521, 522

[56] References Cited

U.S. PATENT DOCUMENTS

| | | | |
|---|---|---|---|
| 384,076 | 6/1888 | Riedell | 451/520 |
| 4,058,936 | 11/1977 | Marton | 451/359 |
| 4,422,239 | 12/1983 | Maier et al. | 451/456 |
| 4,765,099 | 8/1988 | Tanner | 451/359 |
| 5,218,790 | 6/1993 | Huang | 451/359 |
| 5,228,244 | 7/1993 | Chu | 451/344 |
| 5,319,889 | 6/1994 | Rudolf et al. | 451/359 |

*Primary Examiner*—Bruce M. Kisliuk
*Assistant Examiner*—Andrew Weinberg
*Attorney, Agent, or Firm*—Michael J. Striker

[57] ABSTRACT

Smoothing mill for compressed ejectors (3,4) of several stages, incorporated, for suction of dust generated and for conveying it through a flexible tube (19) to a collecting area, use being made of the compressed air discharged from the motor (40) which sets the abrasive disk (9) in rotation.

4 Claims, 5 Drawing Sheets

SMOOTHING MILL WITH SUCTION, BY DEPRESSION IN THREE STAGES, OF DUST SO GENERATED

Figure 1:
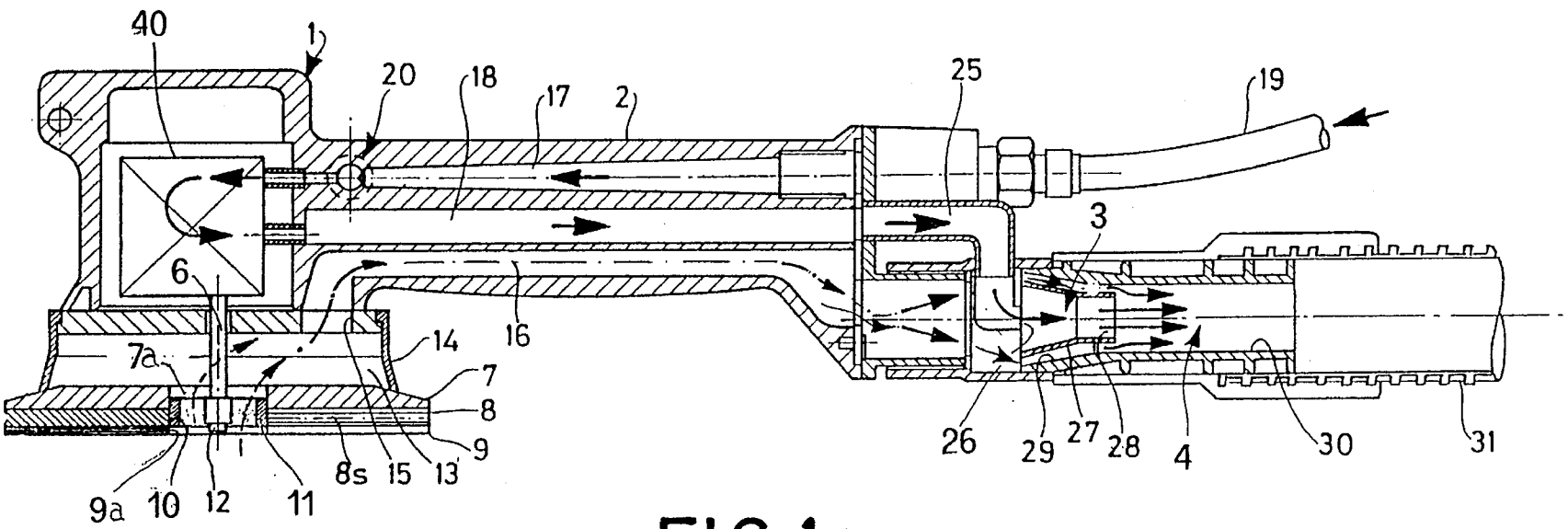

The present invention concerns smoothing mills for finishing the surfaces of manufactured articles or for preparing such articles for subsequent treatment.

Smoothing mills, particularly the disk type, are well-known tools and by means of an abrasive body, especially a rotating disk, are used for treating the surface of structures such as the body of a car, a piece of wooden furniture, flooring or thresholds of stone or wood, to obtain a good finish or to prepare the surface for further treatment such as painting.

Special devices enable the dust, produced by the abrasive body on the-surface to which said body is applied, to be sucked up and carried into chambers placed for the purpose, in order to keep the environment cleaner and healthier. Suction and damping down the dust produced by such work is an important aspect of the process.

In one known model there is a fan fitted onto the motor shaft that rotates the plate-shaped part carrying the abrasive disk.

The fan sucks up air and dust through a set of holes in the plate and in the abrasive disk and conveys it into a tube. Suction produced by the fan, moved by the same rotating shaft as that moving the abrasive disk, is in no way sufficient for the purpose.

To overcome this insufficiency use is made of a separate self-propelled electric suction fan (of the bin-type vacuum cleaner) whose suction tube is connected to the smoothing mill.

A drawback to this system is the awkward presence of the electric cable feeding the fan as well as the high consumption of energy involved.

Other systems comprise a fixed suction system having one or more articulated arms carrying suction tubes connected to one or more smoothing mills by couplings at the ends of said arms.

These fixed installations require a considerable investment and maintenance costs are also high.

Further, coupling the smoothing mill to an articulated arm of the system limits movement, and consumption of energy is even higher than that for a mobile suction unit.

Purpose of the present invention is to provide a smoothing mill comprising built-in means of dust suction which are more powerful, more effective and more efficient.

A further purpose is to exploit the air discharged by the motor and the compressed air from the machine, which would otherwise be lost, and this saves a great deal of energy. Subject of the invention is a smoothing mill comprising a suction duct for generated dust and a suction device made by fitting inside said suction duct one or more tubular ejectors each comprising an initial truncated-cone shaped chamber and a final cylindrical chamber.

Said ejectors are arranged coaxially in series, one partially inside another, with the truncated-cone shaped part preceding the cylindrical part, in the direction of suction. The compressed air enters the first of these ejectors through a coaxial nozzle.

Internal diameter of the cylindrical chambers is equal to the lesser diameter of the truncated-cone shaped chambers preceding them.

Internal diameters of the second ejector are greater than the corresponding ones of the first ejector while internal diameters of the third ejector are greater than the corresponding diameters of the second ejector, and so on.

In this way a smooth passage of air in the cavities among the ejectors arranged in series is assured.

The overall purpose is to obtain, for each ejector and by associated action of the truncated-cone and cylindrically shaped chambers, a high progressively multiplying capacity and suction power in the various stages of suction created by the ejectors arranged in series.

The first ejector lies practically inside the truncated-cone shaped chamber of the second ejector which in turn lies practically inside the truncated-cone shaped chamber of the third ejector.

In a preferred execution the smoothing mill is of the disk type.

Said disk is mounted at the end of the shaft of a motor and comprises a suction chamber placed behind said disk and communicating with the working area through a specially made aperture in the disk.

The dust suction duct communicates with said suction chamber through apertures made in the top of said chamber. The nozzle of the compressed air duct communicates with the first truncated cone-cylindrical ejector at a position practically on the front edge of said ejector.

In a preferred type of execution the smoothing mill is worked by a compressed air motor, the compressed air discharged by said motor being used to feed the nozzle associated to the truncated cone-cylindrical ejector.

A valve for regulating opening and closing of the passage for fluid is fitted on the duct bringing in compressed air. Said valve comprises a shutter whose position in relation to the valve can be continuously adjusted by a ring nut. By moving the lever that works the valve and adjusting rotation of the ring nut, the quantity of compressed air can be regulated as required.

In another type of execution the smoothing mill is operated by an electric motor, the nozzle associated to the truncated cone-cylindrical ejector being connected to a generator of compressed air by a flexible tube.

The above-mentioned abrasive disk is supported by a plate, the surface that couples it to said disk being virtually annular and containing radial grooves which extend from a central lower zone to the outer circumference.

Said abrasive disk is held in place by a retaining part with radial arms that compress said abrasive disk and, bending it, force it inside said grooves.

The openings for dust suction through said plate and abrasive disk, and which are formed inside said lower central zone of said plate, through the radial grooves referred to above ensure suction paths for said ejectors which will not become blocked up during operation even when the abrasive disk is in contact with the work surface.

The invention clearly offers many advantages.

By the use of a compressed air motor, the flow of compressed air discharged by the motor forms the primary fluid that actuating the dust suction system thus ensuring a rational form of operation and and economy in consumption of energy by the machine.

Suction of dust by a number of ejectors, and therefore in several stages, gives rise to increased effects appreciably raising the power of suction, capacity and efficiency. The presence of radial grooves on the working surface of the abrasive disk improves suction of dust produced while the smoothing mill is in operation.

Said radial grooves collect within them a large proportion of the dust produced during rotation, interception and suction being more immediate. Under all conditions, therefore, these radial grooves ensure suction of air from outside close to the external circumference of the rotating abrasive disk, preventing interruption in the suction flow during work.

Characteristics and purposes of the invention will be made still clearer by the following examples of its execution illustrated by diagrammatically drawn figures.

FIG. 1 The invented smoothing mill with compressed air motor and two-stage suction, longitudinal section.

Figure 2:
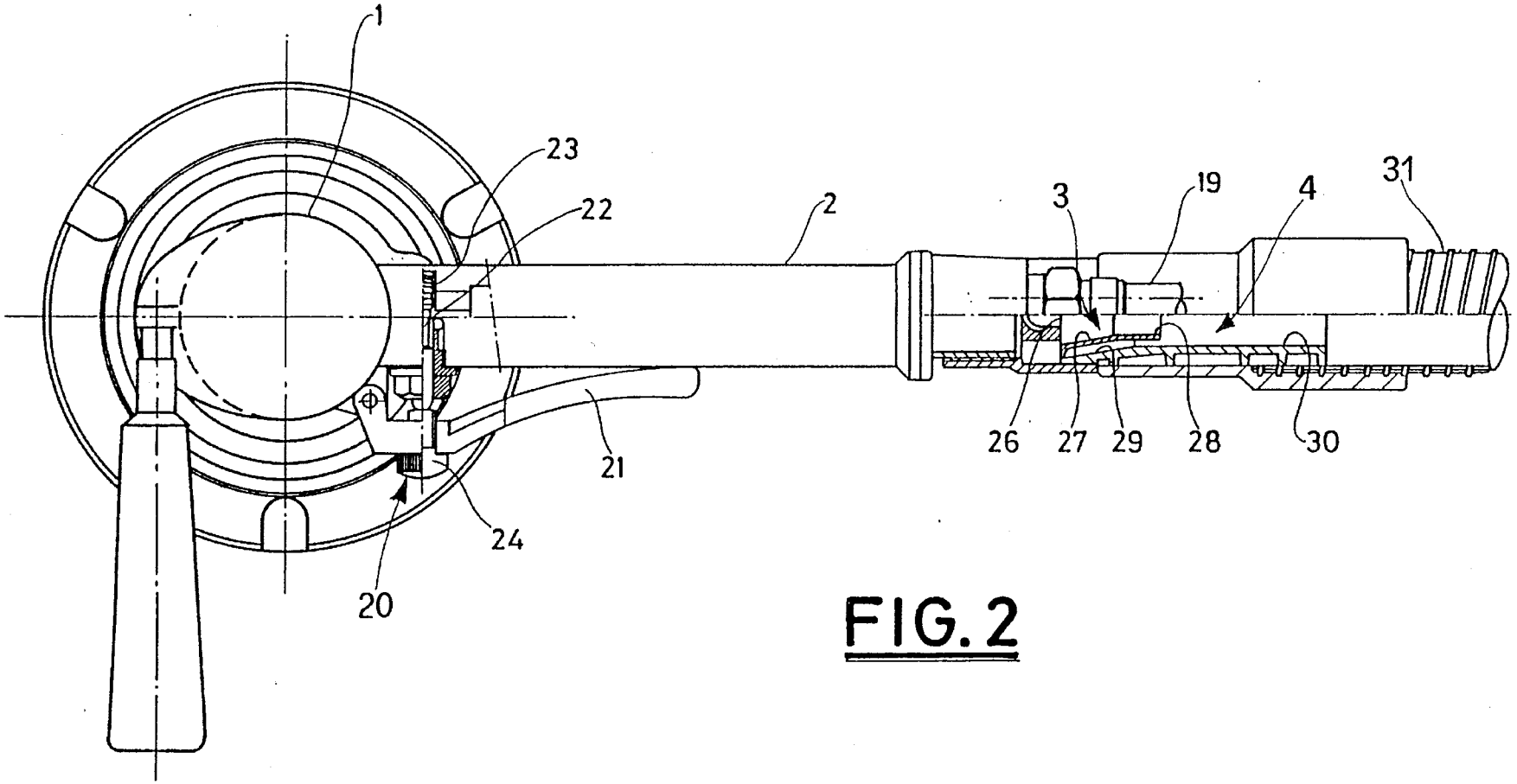

FIG. 2 Plan view of the mill partially cut away.

Figure 3:
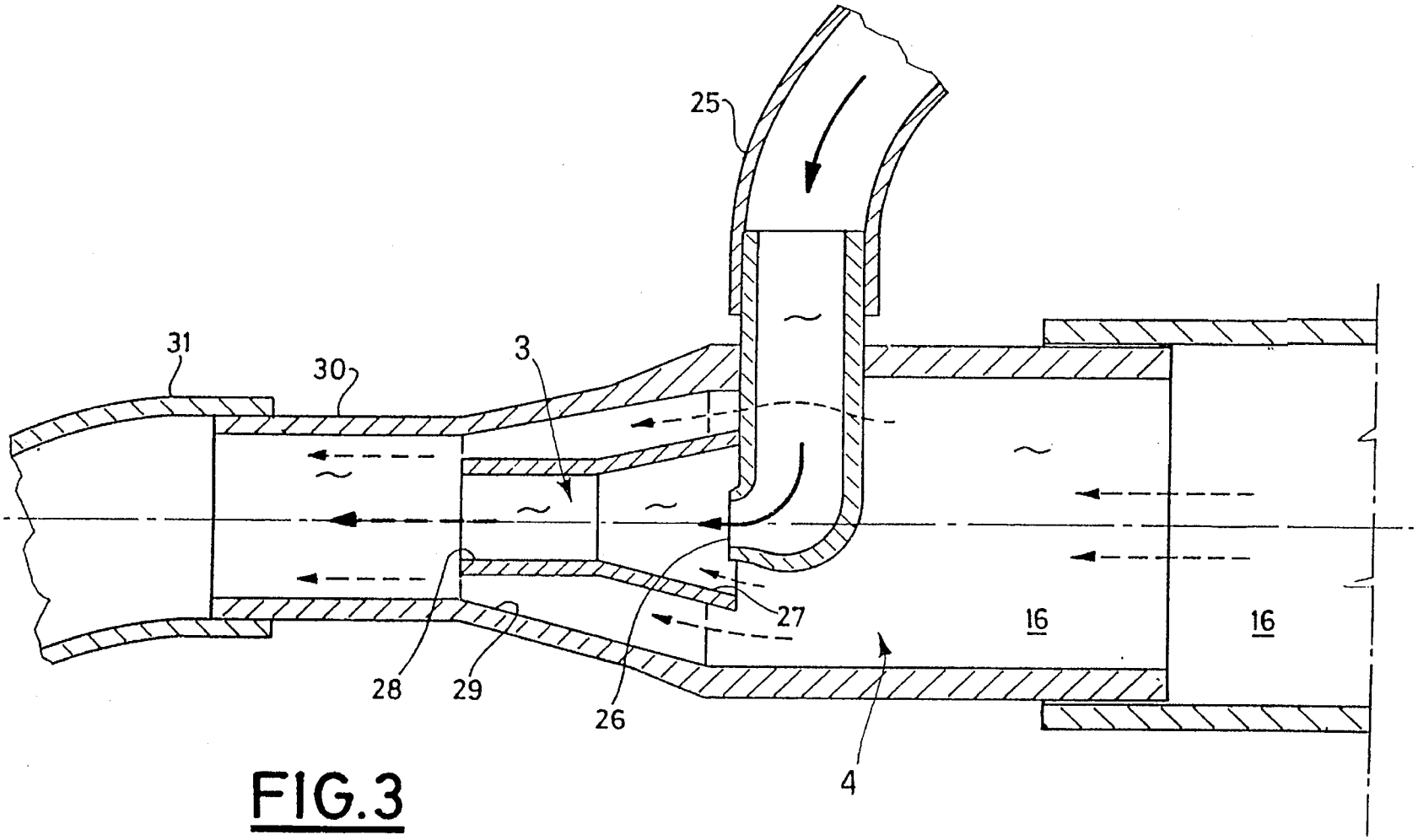

FIG. 3 Detail of the two-stage suction device.

Figure 4:
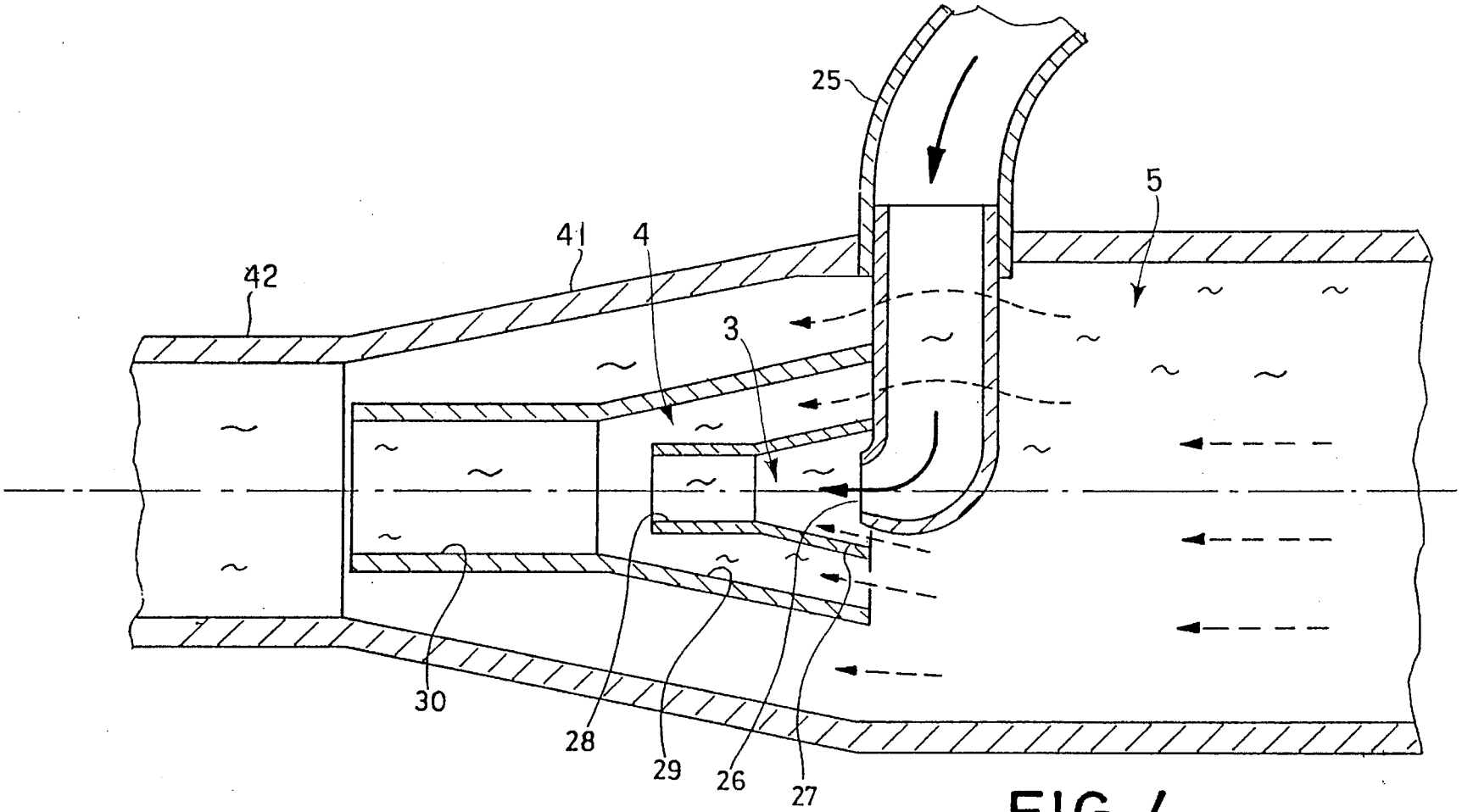

FIG. 4 Detail of the three-stage suction device.

Figure 5:
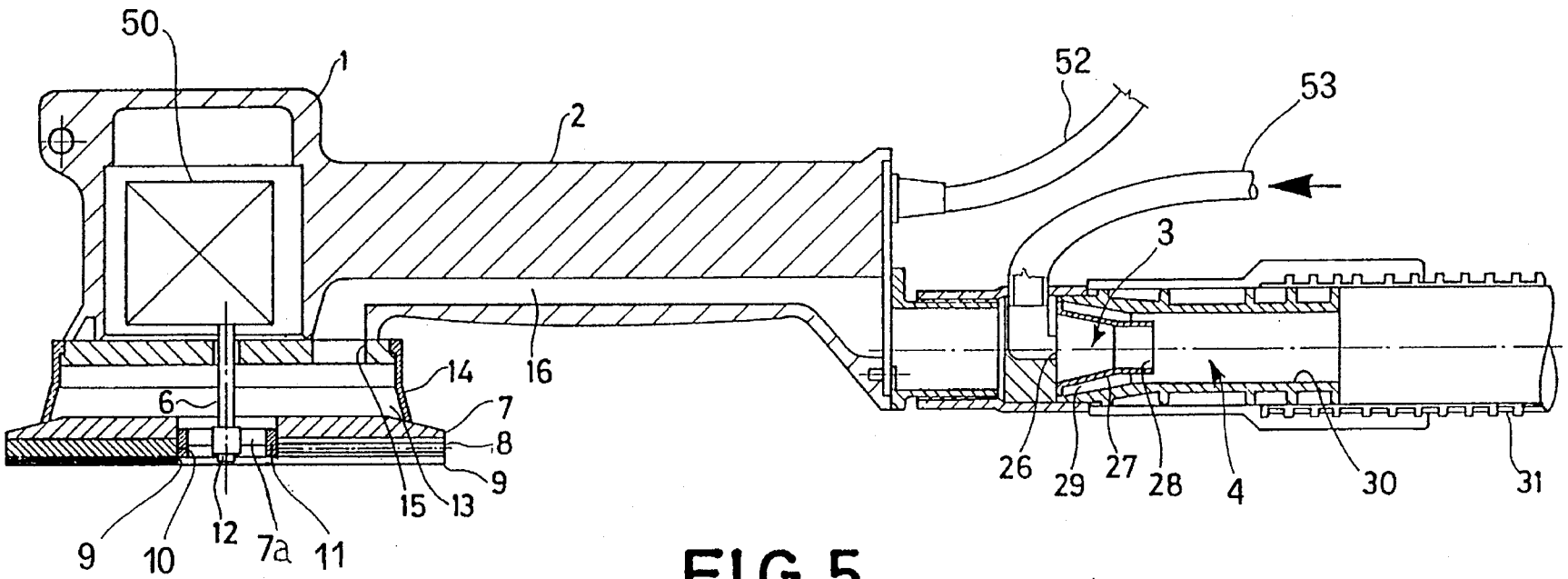

FIG. 5 Smoothing mill with electric motor, longitudinal section.

The smoothing mill comprises a body 1 of die-cast plastic material, provided with a handle 2.

A compressed air motor 40 is installed inside said body 1. On the end of the shaft 6 of said motor, a plate 7 has been mounted to which plate is fitted an abrasive disk 9, with a pad 8 of elastic material interposed between them.

In said pad 8 there/is a central hole 10 and two or more radial grooves 8*s*, angularly spaced one from another and extending from said central hole 10 to the outer edge of said abrasive disk 9.

The abrasive disk 9 is locked in place by a retaining part 11, this in turn being fixed to the end of the shaft 6 by a screw 12.

In the plate 7 there is an opening 7*a* whose position corresponds to that of the central hole 10 in the pad, and similarly there is a central hole 9*a* in the disk 9.

On the back of the plate 7 there is a suction chamber 13 with cylindrical walls 14 of a flexible material.

Said chamber 13 communicates through a hole 15 at its top with a longitudinal duct 16 made in the handle 2.

Inside said handle 2 are two more ducts, practically parallel to the first, respectively a duct 17 carrying compressed air and a duct 18 for discharging it.

Compressed air is received from a flexible tube 19.

On the compressed air entry duct 17, upstream of the motor 30, is mounted a control valve 20 that can be worked by the operator by an external lever 21 acting on a shutter 20 with a pin and return spring 23.

The end position of the shutter 22 when the valve 20 is is opened, obtained by moving the lever 21, can be adjusted by means of a knurled ring nut 24 supported by the lever 21, so that micrometric regulation of the rotating speed of the abrasive disk can easily be done by increasing or reducing the passage opening of the valve 20.

Having started up the motor 40, the compressed air returns through the duct 18 from where it flows into the nozzle 26 in line with a tubular ejector 3 which, in the direction of forward movement of the compressed air, comprises an initial truncated-cone shaped part 27 and a second cylindrical part 28 whose internal diameter is equal to the lesser diameter of the truncated cone.

The ejector 3 sucks up air and dust from the working area through the duct 16, the hole 15 in the chamber 13 on the plate 7, the holes 7*a* in said plate, those 9*a* in the abrasive disk 9, and hole 10 in the rubber pad 8.

The ejector 3 is surrounded by a second ejector 4 formed of a tubular body comprising an initial truncated-cone shaped part 29 and a second cylindrical part 30.

The jet flowing from the first ejector 3 therefore penetrates into the second ejector 4 at the position of the second cylindrical part 30.

A further flow of air is created in the cavity between the first ejector 3 and the second ejector 4, making the flow passing from the first ejector more powerful.

A flexible discharge tube 31 connected to the end of the body of ejector 4, carries discharged compressed air from the motor, the dust produced by the process and outside air sucked in from the working area towards a collecting chamber.

In the figures the path followed by the compressed air is is indicated by arrows and continuous lines while those taken by the mixture received from the ejectors and carried to the collecting chamber are indicated by arrows and dotted lines.

The best suction is obtained when the end of the nozzle 26 is placed practically flush with the front edge of the first ejector 3.

FIG. 4 shows a variation.

The second ejector 4 is in turn lodged inside a tubular body constituting a third ejector 5 comprising an initial truncated-cone shaped part 41 and a second cylindrical part 42.

The end of said tubular body is connected to the discharge tube for dust, like the tube 30 in FIG. 1.

FIG. 5 illustrates a further version.

Rotation of the abrasive disk 9 is obtained by an electric motor 50 fed through an electric cable 52.

A flexible tube 53, for feeding in compressed air as the primary fluid for the dust suction system, is directly connected to the nozzle 26 coaxial with the first ejector 3. In locking the abrasive disk 9 the retaining part 11 is aided by the radial arms which bend the abrasive sheet inside the radial grooves 8*s* in the rubber pad.

The coordinated openings in the disk 9, plate 7 and pad 8, corresponding to the central lower area of the working surface of the plate 7, keep said central lower area in communication with the outer air even when the abrasive disk is pressed against a flat surface. This makes suction of dust from the process more efficient still, as has been already explained.

I claim:

1. Smoothing mill with abrasive disc supported by a first surface of a plate rotatably driven by a motor, the other side of the plate forming one of the walls of a dust suction chamber, central apertures being provided through the abrasive disc, said apertures being able to communicate with the dust suction chamber through corresponding central apertures in the supporting plate, the smoothing mill further comprising a suction duct that communicates with the suction chamber by means of apertures in the walls of the dust suction chamber that lies opposite to the supporting plate characterized in that one or more ejectors are inserted in the suction duct, there being upstream for each ejector a truncated-cone shaped chamber which is connected, at its lesser diameter, to a cylindrical chamber downstream, one placed partially inside the other and coaxially with a nozzle through which compressed air is introduced into the first of said ejectors to obtain progressively greater capacity and suction power, the first surface of the plate being substantially circular and comprising radial grooves that extend from the periphery of said plate towards a central zone, said first surface further comprising the central apertures through which the dust suction chamber is able to communicate with the central apertures of the abrasive disc, held in place by a retaining part having radial arms that compress said disc and bend it inside said radial grooves, said grooves providing dust suction paths which will not become logged during the work even when the abrasive disc is in contact with the working surface and where the motor is driven by compressed air, the compressed air discharged from said motor being used to supply the nozzle.

2. Smoothing mill as in claim 1 characterized in that the ejectors are tubular and are placed in series with the truncated-cone shaped part that, in relation to the direction of suction, precedes the cylindrical part, the internal diameter of the cylindrical chamber coinciding with the lesser diameter of the truncated-cone shaped chamber, the internal diameters of one ejector being greater than the corresponding ones of the ejector that precedes it, one ejector being placed substantially inside the truncated-cone shaped chamber of the ejector that precedes it, the purpose of this being to obtain progressively greater capacity and suction power in accordance with the various stages of suction created by said ejectors arranged in series.

3. Smoothing mill as in claim 1 characterized in that the motor is driven by compressed air there being placed on the pipe that brings compressed air to the motor, a valve with a control lever for opening and closing the aperture for passage of fluid, comprising a shutter whose position in relation to said valve can be continuously adjusted by means of a ring nut supported by said lever, it thus being possible, by adjusting rotation of the ring nut, to use the lever to assure delivery of compressed air suited to different working requirements.

4. Smoothing mill as in claim 1 characterized in that the motor is electric, the nozzle being connected to a generator of compressed air through a flexible tube.

* * * * *